US007438860B2

(12) United States Patent
Takagi et al.

(10) Patent No.: US 7,438,860 B2
(45) Date of Patent: Oct. 21, 2008

(54) DROPLET DISCHARGING HEAD AND MICROARRAY MANUFACTURING METHOD

(75) Inventors: Fumio Takagi, Nagano-ken (JP); Kazuhiko Ishihara, 8-17, Iguchi 5-chome, Mitaka-shi, Tokyo, 181-0011 (JP)

(73) Assignees: Seiko Epson Corporation (JP); Kazuhiko Ishihara (JP)

( * ) Notice: Subject to any disclaimer, the term of this patent is extended or adjusted under 35 U.S.C. 154(b) by 971 days.

(21) Appl. No.: 10/850,056

(22) Filed: May 20, 2004

(65) Prior Publication Data

US 2005/0008497 A1 Jan. 13, 2005

(30) Foreign Application Priority Data

May 28, 2003 (JP) ..... 2003-150277
Apr. 2, 2004 (JP) ..... 2004-109851

(51) Int. Cl.
*B01L 3/02* (2006.01)

(52) U.S. Cl. ..... 422/100; 73/863.32; 73/864; 73/864.01

(58) Field of Classification Search ..... 422/100, 422/102; 73/863.32, 864, 864.01, 864.02
See application file for complete search history.

(56) References Cited

U.S. PATENT DOCUMENTS 4,385,637 A * 5/1983 Akhavi ..... 600/576
5,332,551 A * 7/1994 Koontz ..... 422/129
5,550,060 A * 8/1996 Saunders et al. ..... 436/63
6,207,112 B1 * 3/2001 Spallek et al. ..... 422/100
6,537,432 B1 * 3/2003 Schneider et al. ..... 204/450
6,835,293 B2 * 12/2004 Gerlach et al. ..... 204/600
6,849,396 B2 * 2/2005 Schneider ..... 435/4
7,150,999 B1 * 12/2006 Shuck ..... 436/180
7,220,334 B2 * 5/2007 Anazawa et al. ..... 156/235
7,247,274 B1 * 7/2007 Chow ..... 422/100
2001/0023827 A1 * 9/2001 Liu et al. ..... 204/605
2006/0062696 A1 * 3/2006 Chow et al. ..... 422/100

FOREIGN PATENT DOCUMENTS

JP 11-187900 7/1999

* cited by examiner

*Primary Examiner*—Brian R. Gordon
(74) *Attorney, Agent, or Firm*—Harness, Dickey & Pierce, P.L.C.

(57) ABSTRACT

It is an object of the present invention to provide a droplet discharging head suited to the discharge of a sample solution, and particularly one that contains a bio-related substance. This object is achieved by a droplet discharging head 1 for discharging a sample solution, wherein the portion of the inner walls of the droplet discharging head 1 that comes into contact with the sample solution is covered with a polymer composed of phosphorylcholine group-containing unsaturated compound units, or a copolymer including same. The droplet discharging head is preferably an electrostatic drive or piezoelectric drive type.

10 Claims, 5 Drawing Sheets

DROPLET DISCHARGING HEAD AND MICROARRAY MANUFACTURING METHOD

BACKGROUND OF INVENTION

1. Field of the Invention

The present invention relates to a droplet discharging head, and more particularly relates to a droplet discharging head suited to the discharge of a bio-related substance.

2. Description of the Related Art

The decoding of DNA base sequences and the functional analysis of genetic information have become topics of great interest in recent years, and DNA microarrays have been utilized for monitoring gene expression patterns and for screening new genes. With these arrays, probe DNA is prepared and spotted at high density on a substrate such as a slide glass, after which the portion of fluorescent-labeled target DNA having base sequences that are compatible with the probe DNA is hybridized and the fluorescent pattern is observed, which gives an evaluation of the amount of gene expression. The size of these arrays is usually from 1 to 10 $cm^2$, and from several thousand to several tens of thousands of types of probe DNA must be spotted at high density in this area. Up to now the fixing of the probe DNA has been performed using contact pins.

With the completion of the genome project, focus has shifted to protein analysis as the next phase, and protein chips that make use of the same mechanism as a DNA microarray have been developed.

In this situation, a method for fixing probe DNA or a protein by using inkjet discharge technology has been proposed.

SUMMARY OF THE INVENTION

With inkjet discharge technology, a stable spot shape can be formed quickly, and a microarray of high density can be produced by setting a narrow nozzle pitch.

However, proteins are used as the probe in the production of protein chips, but when a solution containing protein is used in an inkjet head, the protein may adsorb (adhere) to the inner walls of the inkjet head, which can markedly affect channel performance and therefore diminish discharge performance. Another result of this adsorption (adhesion) to the inner walls of the inkjet head is that the concentration of the sample solution may be inconsistent, and the protein structure itself may change, resulting in a lost of the activity which the protein has originally.

In view of this, it is an object of the present invention to provide a droplet discharging head that can be used to particular advantage with bio-related substances.

It is another object of the present invention to provide a method for manufacturing a droplet discharging head and a method for manufacturing a microarray, with which the fixing of a probe on a solid phase can be accomplished quickly and simply, without damaging a bio-related substance.

To achieve the stated objects, the droplet discharging head of the present invention is a droplet discharging head for discharging a sample solution, wherein the portion of the inner walls of the droplet discharging head that comes into contact with the sample solution is covered with a polymer composed of phosphorylcholine group-containing unsaturated compound units, or a copolymer including same.

With this constitution, since the portion that comes into contact with the sample solution is covered with a (co)polymer containing phospholipid polar groups (phosphorylcholine groups), which are constituent components of biological membranes, it is possible to provide a droplet discharging head with superior biocompatibility. Therefore, the discharge problems caused by interaction between the sample and the inner walls of the droplet discharging head, that is, the adsorption of components in the sample solution to the inner walls, can be prevented. It is also possible to prevent loss of activity due to a change in structure when a bio-related substance (such as a protein) contained in the sample solution adsorbs to the inner walls of the droplet discharging head. Also, since adsorption of the sample to the inner walls and so forth can be prevented, it should be possible to prevent changes in the concentration of the sample solution over time as well. The phrase "portion of the inner walls of the droplet discharging head that comes into contact with the sample solution" used here refers to the inner walls of the passages (channels) through which the solution passes, and more specifically refers to the inner walls of the channels through which the solution passes from the reservoir chamber to the nozzle holes, for example. The term "channels" here encompasses the reservoir chamber, pressurization chamber, and so on formed along the channel.

A solution containing a bio-related substance, for example, can be used favorably as the sample solution in the present invention. In specific terms, bio-related substances include cells, proteins, nucleic acids, and other such biological substances, as well as artificially synthesized oligonucleotides, polynucleotides, oligopeptides, polypeptides, PNA (peptide nucleic acids), and other such analogs.

The above-mentioned droplet discharging head is preferably an electrostatic drive or piezoelectric drive type. With this type of head, no heat is generated as with a so-called thermal inkjet type, so stable discharge on a solid phase surface is possible without damaging the bio-related substances contained in the sample solution, for example.

The droplet discharging head pertaining to another aspect of the present invention is droplet discharging head for discharging a sample solution, comprising a first substrate having one or more electrodes on its surface, a second substrate that has an oscillating plate disposed so as to oppose the portion of the first substrate where the electrode is installed, with a microscopic gap therebetween, and elastically deforming under electrostatic force corresponding to the potential difference from the electrode, and that has one or more pressurization chambers whose internal pressure is regulated by the displacement of the oscillating plate, and which pushes the sample solution contained in said pressurization chamber out through nozzle holes, a third substrate having one or more nozzle holes for discharging the sample solution pushed out of the pressurization chamber, and a reservoir component that is disposed on the other side of the first substrate and has a reservoir chamber for holding the sample solution, wherein channels leading from the reservoir component to the pressurization chamber are provided to the first substrate and second substrate, and the inner walls of at least the reservoir component, the pressurization chamber, the channels, and the nozzle holes are covered with a polymer composed of phosphorylcholine group-containing unsaturated compound units, or a copolymer including same.

With this constitution, since the portion that comes into contact with the sample solution is covered with a (co)polymer containing phospholipid polar groups (phosphorylcholine groups), which are constituent components of biological membranes, it is possible to provide a droplet discharging head with superior biocompatibility. Therefore, the discharge problems caused by interaction between the sample and the inner walls of the droplet discharging head, that is, the adsorption of components in the sample solution to the inner walls, can be prevented. It is also possible to prevent loss of activity due to a change in structure when a bio-related substance (such as a protein) contained in the sample solution adsorbs to the inner walls of the droplet discharging head. Also, since adsorption of the sample to the inner walls and so forth can be prevented, it should be possible to prevent changes in the concentration of the sample solution over time as well. Also, since an electrostatically driven head is employed, which does not generate heat as with a so-called thermal inkjet type, stable discharge on a solid phase surface is possible without damaging the bio-related substances contained in the sample solution, for example. Also, since a plurality of reservoir chambers, pressurization chambers, nozzles, and channels connecting these are provided on each substrate, they can all be worked at the same time, so a droplet discharging head with which more types of sample solution of DNA, proteins, or the like can be spotted can be obtained by a simple procedure.

The above-mentioned phosphorylcholine group-containing unsaturated compound units are preferably 2-methacryloyloxyethyl phosphorylcholine (hereinafter referred to as MPC) units. Since MPC is used, which includes in a single molecule a phospholipid group (phosphorylcholine group) as a constituent components of biological membranes and a methacryloyl group with excellent polymerizability, biocompatibility and coating formability are excellent, so the adsorption of bio-related substances such as proteins contained in the sample solution can be effectively prevented.

The above-mentioned copolymer containing phosphorylcholine group-containing unsaturated compound units may contain as constituent units 2-methacryloyloxyethyl phosphorylcholine units and (meth)acrylic ester units. With this constitution, biocompatibility is good because the phosphorylcholine group-containing unsaturated units are contained, and mechanical strength is good because the (meth)acrylic ester units are contained.

It is preferable for the above-mentioned copolymer containing phosphorylcholine group-containing unsaturated compound units to contain as constituent units 2-methacryloyloxyethyl phosphorylcholine units and silane group-containing unsaturated compound units that generate silanol groups when hydrolyzed. With this constitution, the biocompatibility effect is sustained for a longer period, so it is believed that the adsorption of proteins and other such bio-related substances can be prevented for an extended period.

The droplet discharging head is preferably composed of glass and/or silicon. Glass and silicon are favorable because they allow fine working by photolithography. Also, if the copolymer containing phosphorylcholine group-containing unsaturated compound units contains silane group-containing unsaturated compound units that generate silanol groups when hydrolyzed, bondability with silanol groups will be better, allowing a more stable coating to be formed.

It is preferable for the first substrate to be a glass substrate and the second substrate a silicon substrate. This constitution is favorable because it allows fine working by photolithography. Also, if an electrostatically driven head is used, durability will be better because silicon is used as the oscillating plate of the pressurization chamber. Also, if silane group-containing unsaturated compound units that generate silanol groups when hydrolyzed are contained as constituent units of the copolymer containing phosphorylcholine group-containing unsaturated compound units, bondability with silanol groups will be better, allowing a more stable coating to be formed.

It is preferable for the second substrate to be a silicon substrate, and for a silicon oxide film to be further formed between the inner walls of the pressurization chamber with which the second substrate is equipped and the coating formed by the polymer composed of phosphorylcholine group-containing unsaturated compound units, or a copolymer including same. This constitution affords better bondability with the component that forms the coating.

It is preferable for the nozzle surface near the nozzle holes to be water-repellant. If the nozzle surface is water-repellant, the sample solution (such as a solution containing a bio-related substance) can be effectively prevented from being mixed at the nozzle surface, for example.

The method of the present invention for manufacturing a droplet discharging head for discharging a sample solution comprises the steps of causing a solution containing a polymer composed of phosphorylcholine group-containing unsaturated compound units, or a copolymer including same, to adsorb (adhere) to a solution channel that extends from the sample solution supply opening to the droplet discharge nozzle, and drying the adsorbed solution and forming on the inside of the channel a coating composed of a polymer composed of phosphorylcholine group-containing unsaturated compound units, or a copolymer including same.

With this constitution, a coating composed of a (co)polymer containing phospholipid polar groups (phosphorylcholine groups), which are constituent components of biological membranes, can be formed over the portion of the head that comes into contact with the sample solution, so a droplet discharging head with superior biocompatibility can be provided. It is therefore possible to provide a droplet discharging head with which there is no deactivation due to structural change when a bio-related substance (such as a protein) adsorbs to the inner walls of the droplet discharging head, or to change in the concentration of the sample solution when a component in the sample solution adsorbs to the inner walls of the droplet discharging head.

The above-mentioned adsorption step may be a step of causing adsorption by filling the solution channel that extends from the sample solution supply opening to the droplet discharge nozzle with a solution containing a polymer composed of phosphorylcholine group-containing unsaturated compound units, or a copolymer including same. With this constitution, the component that forms the coating can be made to thoroughly cover the portion with which the sample solution comes into contact, so it is possible to form an even coating over this portion.

The method of the present invention for manufacturing a droplet discharging head in another aspect comprises a step of filling the reservoir chamber, the pressurization chamber, the channel, and the nozzle holes of a droplet discharging head comprising at least a reservoir chamber for holding a sample solution containing a bio-related substance (hereinafter also referred to as a bio-related substance-containing solution), a pressurization chamber for applying pressure in order to discharge the bio-related substance-containing solution, a channel connecting the reservoir chamber and the pressurization chamber, and nozzle holes from which the droplets pressurized in the pressurization chamber are discharged, with a solution containing a polymer composed of phosphorylcholine group-containing unsaturated compound units, or a copolymer including same, and a step of evaporating the solvent from the above-mentioned solution and forming a coating composed of the above-mentioned polymer or copolymer.

With this constitution, a film composed of a (co)polymer containing phospholipid polar groups (phosphorylcholine groups), which are constituent components of biological membranes, at the portion that comes into contact with the bio-related substance-containing solution, so a droplet discharging head with superior biocompatibility can be provided. Therefore, a droplet discharging head can be provided with which there is less deactivation due to a change in structure when a bio-related substance (such as a protein) contained in the sample solution adsorbs to the inner walls of the droplet discharging head, or to change in the concentration of the sample solution when a component in the sample solution adsorbs to the inner walls of the droplet discharging head.

A step of heat treating and fixing the coating may also be included. Heat treatment may be performed as needed if the bonding between the substrate and coating formation component will be promoted, as is the case when silanol groups are contained as a coating formation component and the coating is fixed by the dehydration condensation of silanol groups and groups on the substrate surface.

The microarray manufacturing apparatus of the present invention comprises the above-mentioned droplet discharging head and position control means for setting the relative positions of the droplet discharging head and a microarray substrate for receiving the sample solution discharged from the droplet discharging head. With this constitution, a droplet discharging head with superior biocompatibility can be used, so it is possible to prevent deactivation due to structural change when a bio-related substance (such as protein) adsorbs to the inner walls of the droplet discharging head, or to change in the concentration of the sample solution when a component in the sample solution adsorbs to the inner walls of the droplet discharging head. Also, since the positions of the droplet discharging head and the microarray substrate can be controlled relative to one another, the droplet discharging head can be moved to any location on the microarray substrate, which makes it easier to operate the apparatus.

With the method of the present invention for manufacturing a microarray, the above-mentioned droplet discharging head and the above-mentioned microarray manufacturing apparatus are used to discharge a solution containing a probe that binds specifically to a target molecule, and this probe is fixed on the microarray surface. With this constitution, because a droplet discharging head with superior biocompatibility is used, it is possible to prevent deactivation due to structural change when a bio-related substance (such as protein) adsorbs to the inner walls of the droplet discharging head, or to change in the concentration of the sample solution when a component in the sample solution adsorbs to the inner walls of the droplet discharging head. Therefore, a microarray with a consistent probe quantity can be formed.

It is preferable for the droplet discharging head to have a plurality of nozzles, and for each nozzle to discharge a different probe. With this constitution, a microarray can be provided with which numerous tests can be conducted on a single substrate.

DESCRIPTION OF THE PREFERRED EMBODIMENTS

Embodiments of the present invention are now explained with reference to the drawings.

Figure 1:
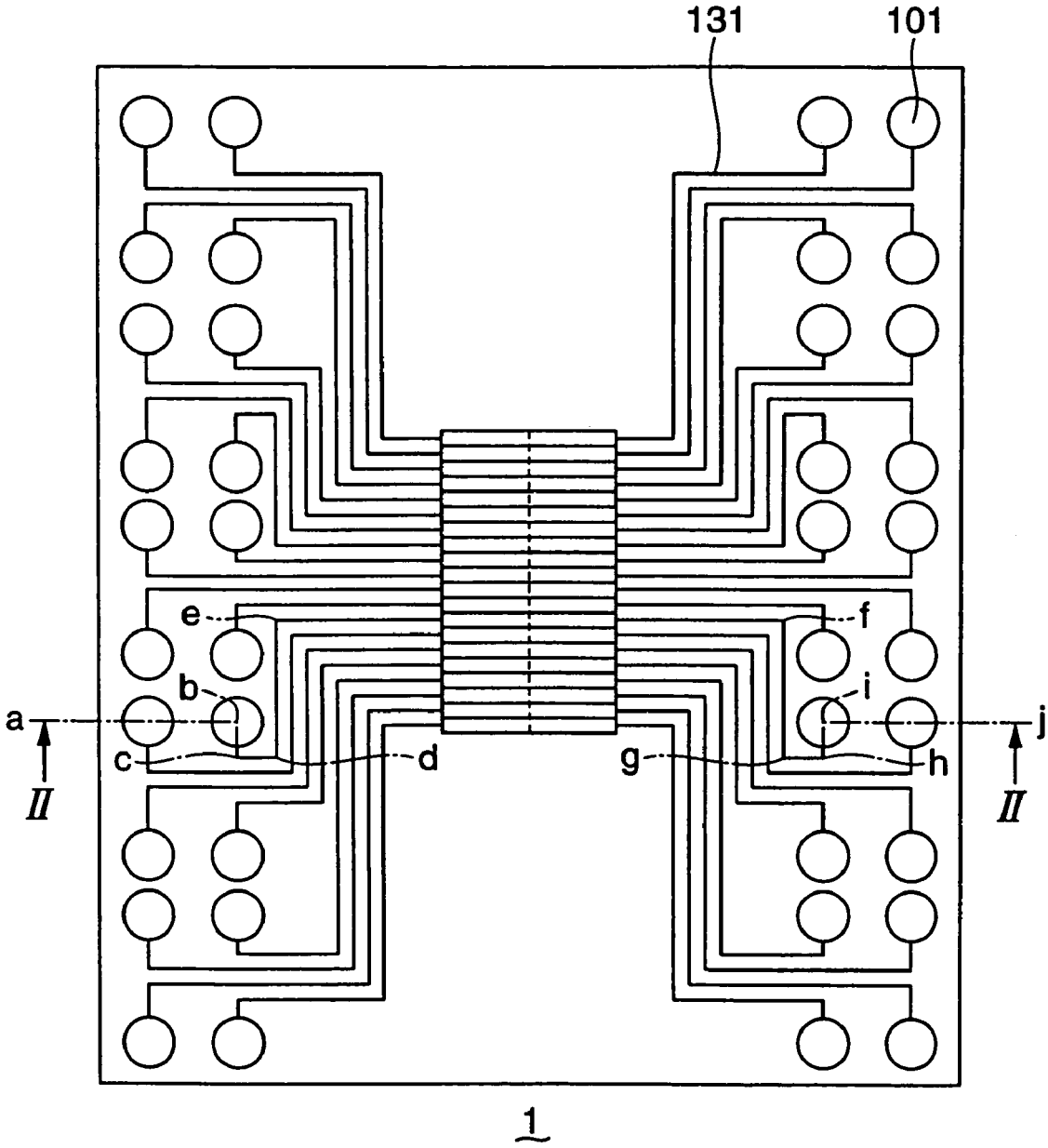
FIG. 1 is a top view of the droplet discharging head according to the first embodiment of the present invention.
Figure 2:
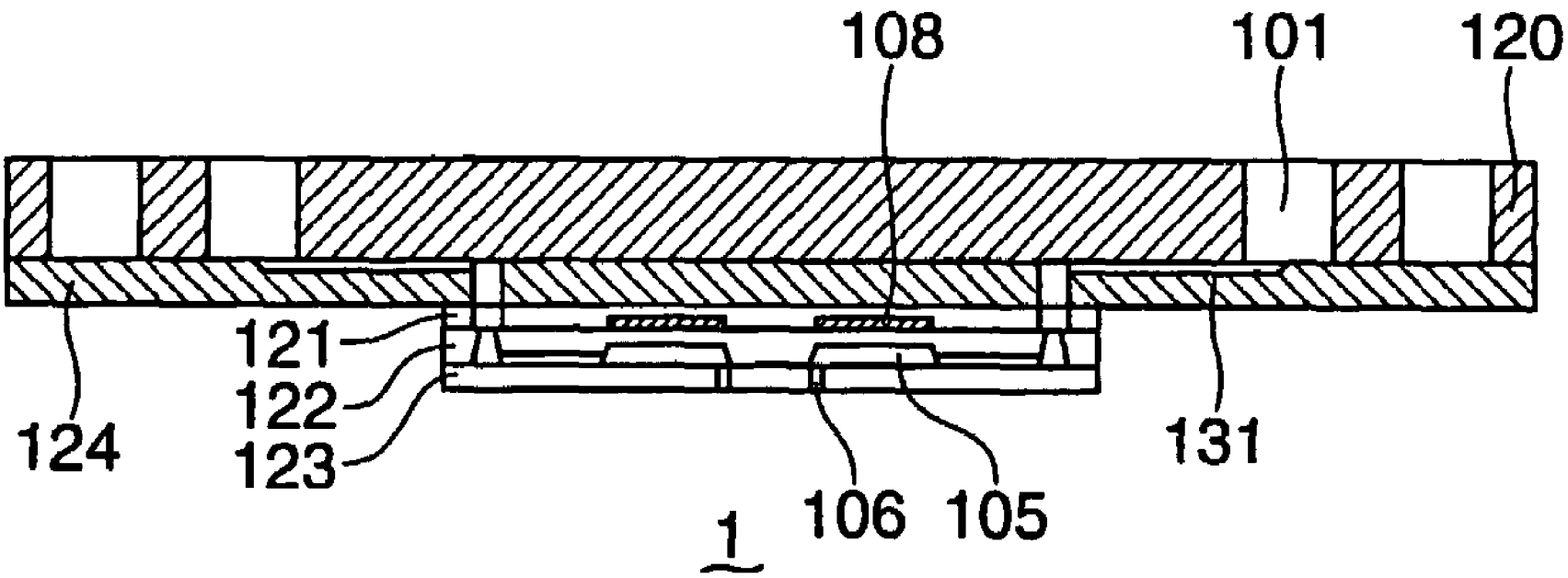
FIG. 2 is a cross section along the a-j line in FIG. 1.
Figure 3:
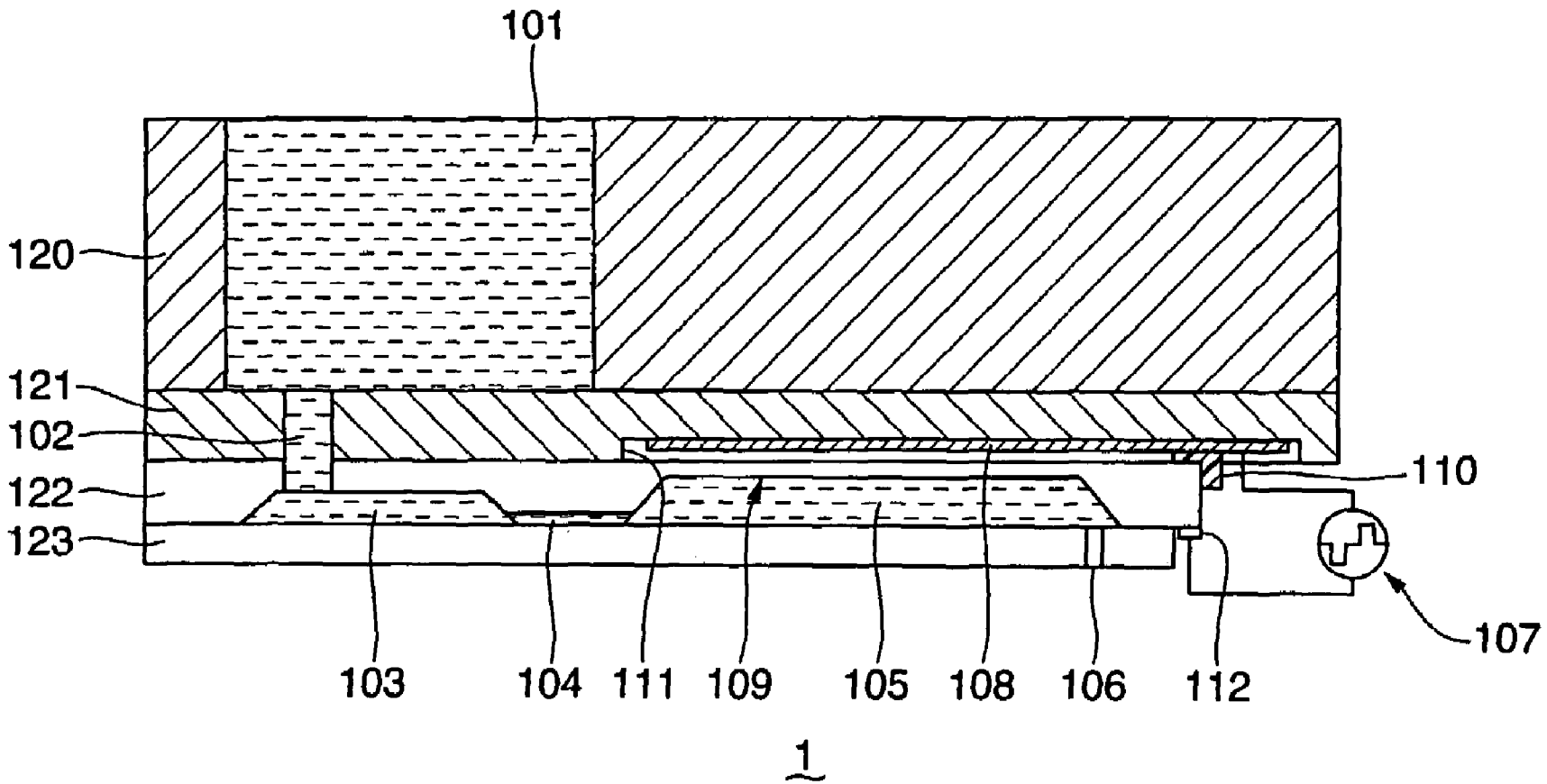
FIG. 3 is a diagram illustrating operating mechanism of the droplet discharging head according to the first embodiment of the present invention.

FIG. 1 is a top view illustrating the basics of the droplet discharging head according to an embodiment of the present invention. FIG. 2 is a cross section of the droplet discharging head along the a-j line in FIG. 1. FIG. 3 is a diagram illustrating operating mechanism of the droplet discharging head according to the embodiment of the present invention.

As shown in FIGS. 1 and 2, the droplet discharging head (inkjet head) 1 according to this embodiment is equipped with a plurality of reservoir chambers 101 capable of holding a bio-related substance such as DNA or a protein. The solutions (the sample solutions) supplied to these reservoir chambers 101 and containing DNA, a protein, or another bio-related substance each go through various microchannels 131 and are guided into a pressurization chamber 105. A change in the internal pressure caused by the elastic displacement of oscillating plates 109 discharges the solutions in the form of droplets from nozzle holes 106.

As shown in FIG. 2, the main components of the droplet discharging head 1 according to this embodiment are a first substrate on which electrodes 108 are formed (hereinafter referred to as the electrode substrate), a second substrate equipped with pressurization chambers 105 for applying pressure in order to discharge the sample solutions (hereinafter referred to as the pressurization chamber substrate), a third substrate having nozzle holes 106 (hereinafter referred to as the nozzle substrate), and a reservoir component 120 having reservoir chambers 101 for holding the above-mentioned sample solutions. If needed, a channel substrate 124 on which are formed the microchannels 131 (hereinafter also referred to simply as channels) connecting the reservoir chambers 101 and the pressurization chambers 105 may also be included.

Next, the structure and operating mechanism of the droplet discharging head according to this embodiment will be described with reference to FIG. 3. To simplify the discussion of FIG. 3, the channel substrate will not be described, and only a droplet discharging head with a four-layer structure comprising the reservoir chambers, the electrode substrate, the pressurization chambers, and the nozzle substrate is described only a single pressurization chamber 105 is shown in FIG. 3.

A pressurization chamber 105 with a concave cross-sectional shape and channels 102, 103, and 104 for supplying sample solutions from the reservoir chambers 101 provided to the reservoir component 120 to the various pressurization chambers 105 are formed on the pressurization chamber substrate 122 on the side across from the nozzle substrate 123. There are no particular restrictions on the shape of the pressurization chambers 105, but when a silicon substrate with a (110) orientation is used and anisotropic etching is performed with a potassium hydroxide aqueous solution or the like, for example, the pressurization chambers 105 have a cross-sectional boat shape consisting of oblique planes that form an angle of approximately 35 degrees to the plane perpendicular to the silicon substrate. The front and back sides of this substrate may be coated with a silicon oxide film formed in a thickness of about 1 μm by hot oxidation. There are no particular restrictions on the shape of the channels 102, 103, and 104, either, and these may be formed simultaneously with the pressurization chambers 105 by etching, for instance. The sample solution from the reservoir chamber 101 goes through the channel 102 provided perpendicular to the substrate, temporarily accumulates in the channel 103 connected below the channel 102, and is sent to the pressurization chamber 105 via the smaller-diameter channel 104.

There are no particular restrictions on the material of which the pressurization chambers 105 are made. Glass, silicon, resin, or the like can be used, but from the standpoint of bondability with silanol groups and fine workability, the use of a glass or silicon substrate is preferred, in particular, from the standpoint of the durability, the use of silicon substrate is preferred. When a silicon substrate is used, it is good to subject the surface thereof to treatment and to form a silicon oxide film on the surface. Bondability with silanol groups can be enhanced by providing a silicon oxide film.

This silicon substrate may be a monocrystalline silicon substrate, polycrystalline silicon substrate, or SOI substrate. Also, the formation of the silicon oxide film is not limited to hot oxidation, and instead sputtering, vapor deposition, ion plating, a sol-gel process, CVD, or any of various other film formation techniques can be utilized.

Nozzle holes 106 for discharging to the outside the sample solutions that have been pressurized in the various pressurization chambers 105 are formed in the nozzle substrate 123 at locations corresponding to the pressurization chambers 105. A silicon substrate or glass substrate can be used as the nozzle substrate 123, for example, but a silicon substrate is particularly favorable. Using a silicon substrate for the nozzle substrate 123 ensures affinity with bio-related substances and also affords excellent workability. A water repellency treatment is preferably performed near the nozzle holes 106 on the opposite side of the nozzle substrate 123 from the side where the pressurization chamber substrate 122 is joined (hereinafter referred to as the nozzle side). Subjecting the nozzle side to a water repellency treatment can prevent cross contamination between the nozzle holes 106.

A recess for forming a substantially constant microscopic gap from the oscillating plate 109 provided at the bottom of the pressurization chamber 105 of the pressurization chamber substrate 122 is formed on the side of the electrode substrate 121 that is across from the pressurization chamber substrate 122, at a location corresponding to the pressurization chambers 105. This microscopic gap should be a necessary and sufficient gap in order for the droplet discharging head 1 to be driven electrostatically, for example, 0.2 μm. A slender electrode 108 for producing electrostatic force between the electrode and the pressurization chamber substrate 122 is formed at the bottom of this recess. The electrode 108 is formed, for example, by sputtering indium tin oxide in a thickness of approximately 0.1 μm.

When a combination of borosilicate glass and silicon substrates is used for the pressurization chamber substrate 122, the electrode substrate 121, and the nozzle substrate 123, the substrates can be joined together by anodic joining, for example. Anodic joining allows the substrates to be joined firmly together by the attractive force of static electricity, so they can be joined very easily.

When silicon substrates are used for the pressurization chamber substrate 122, the electrode substrate 121, and the nozzle substrate 123, the substrates can be joined together using an adhesive agent or the like. When glass substrates are used, they can be joined together using a dilute hydrofluoric acid solution or the like.

The electrode substrate 121 and the pressurization chamber substrate 122 are anodically joined as follows, for instance. Using an electrode substrate 121 composed of a borosilicate glass substrate and a pressurization chamber substrate 122 composed of a silicon substrate, the electrode substrate 121 and the pressurization chamber substrate 122 are precisely positioned so as to be connected by the channel 102 and so that the pressurization chamber 105 corresponds to the electrode 108, suitable bonding pressure is applied, the temperature is raised to between 300 and 500° C., and DC voltage of 200 to 1000 V is applied between the substrates under a vacuum of about $1\times10^{-4}$ Torr or in a nitrogen atmosphere and so that the silicon substrate side has a positive potential. As a result, the sodium ions (alkali metal ions) contained in the borosilicate glass substrate are segregated at the surface on the opposite side (the left side in the drawing) of the borosilicate glass substrate. Meanwhile, the large quantity of negative ions remaining in this substrate form a space-charge layer at the joint with the silicon substrate, a powerful electrostatic attractive force is induced between the silicon substrate and the borosilicate glass substrate, and this firmly joins the two substrates. Furthermore, the borosilicate glass substrate not only contains many alkali ions and is favorable for anodic joining, but also has a coefficient of thermal expansion that substantially matches that of the silicon substrate, which results in better joining with less strain at the joint between the substrates.

In order to maintain the microscopic gap between the pressurization chamber substrate 122 and the electrode substrate 121 after they have been joined, a support member 110 made of an epoxy resin or other material that has excellent insulation and suitable elasticity, is inserted into the microscopic gap at the top part of the pressurization chamber substrate 122.

If a borosilicate glass substrate is used in anodic joining, then MgO, $Al_2O_3$, CaO, or the like can be added to this glass substrate in order to match the coefficient of thermal expansion of the glass substrate to that of the silicon substrate, thereby reducing the thermal stress during anodic joining. Also, it is preferable to reduce the differential in the amount of deformation of the substrates caused by thermal stress by setting the borosilicate glass substrate temperature somewhat higher than that silicon substrate temperature, so that warp can be kept to a minimum at the joint.

The pressurization chamber substrate 122 composed of a silicon substrate is joined to the nozzle substrate 123 with an adhesive agent that will not affect the bio-related substance. A silicon substrate whose surface has undergone an oxidation treatment may be used as the electrode substrate 121 or the nozzle substrate 123. In particular, when a silicon substrate is used for the electrode substrate 121, an electrode layer that serves as the electrode 108 can be formed by diffusing a p- or n-type impurity where the electrode 108 is to be formed.

A through-hole is formed in the reservoir component 120, and this is joined with the electrode substrate 121, thereby forming a reservoir chamber 101 for holding (storing) the sample solution. There are no particular restrictions on the cross sectional shape of the reservoir chamber 101 on the side parallel to the substrate plane, but this shape may be circular or square. From the standpoint of preventing the loss of the sample solution, however, a circular shape is preferred. Also, the reservoir component is formed by through-holes provided to the substrate in this embodiment, but is not limited to this, and may instead be a vessel having a plurality of recesses equipped with through-holes that can communicate with channels connecting the various pressurization chambers.

There are no particular restrictions on the material of the reservoir component 120, which may be glass, silicon, resin, or the like, but from the standpoint of workability, for instance, it is best to use a resin such as an acrylic resin (such as polymethyl methacrylate (PMMA)) or polyvinyl chloride (PVC). The reservoir component 120 and the electrode substrate 121 are joined by adjusting the substrates to their proper positions and fixing them in place with an adhesive agent that will not affect the bio-related substance.

The channel substrate 124 (see FIG. 2) may be formed between the electrode substrate 121 and the reservoir component 120. This channel substrate 124 comprises a silicon substrate or glass substrate, for example, and grooves can be formed therein by etching, for instance, to form microchannels (channels) 131 that connect the reservoir chamber 101 and the channel 102 formed on the electrode substrate.

In this embodiment, the portion of the inner walls of the droplet discharging head that comes into contact with the sample solution is covered with a polymer composed of phosphorylcholine group-containing unsaturated compound units, or a copolymer including same (hereinafter referred to as a phosphorylcholine group-containing (co)polymer). More specifically, with the droplet discharging head of this embodiment, the inner walls of the reservoir chamber 101 containing the sample solution, the channels 102, 103, and 104, the pressurization chamber 105, and the nozzle holes 106 are covered with a phosphorylcholine group-containing (co)polymer.

Examples of phosphorylcholine group-containing unsaturated compounds include MPC, 2-methacryloyloxyethoxyethyl phosphorylcholine, 6-methacryloyloxyhexyl phosphorylcholine, 10-methacryloyloxydecyl phosphorylcholine, allyl phosphorylcholine, butenyl phosphorylcholine, hexenyl phosphorylcholine, octenyl phosphorylcholine, and decenyl phosphorylcholine. Of these, MPC is preferred from the standpoints of polymerizability, ready availability, and so forth. These phosphorylcholine group-containing unsaturated compounds may be used singly or in combinations of two or more types. The phosphorylcholine group-containing unsaturated compound is preferably contained in an amount of 5 to 100 mol %, and more preferably 5 to 90 mol %, and even more preferably 25 to 90 mol %, with respect to the total constituent units. If the amount is less than 5 mol %, biocompatibility of the material will be inadequate. Also, from the standpoint of bondatibility with the substrate surface, it is preferable for the silane group-containing unsaturated compound units discussed below to be contained.

The phosphorylcholine group-containing copolymer can also include constituent units other than phosphorylcholine group-containing unsaturated compound units, such as methacrylic acid, methyl methacrylate, ethyl methacrylate, n-butyl methacrylate, hexyl methacrylate, 2-hydroxyethyl methacrylate, and other such methacrylic esters; or vinyl chloride, acrylonitrile, vinylpyrrolidone, styrene, vinyl acetate, and other such copolymerizable monomer units. Of these, the use of a methacrylic ester is preferred because it affords superior mechanical strength. These copolymerizable monomer units may be used singly or in combinations of two or more types. These copolymerizable monomer units are preferably contained in an amount of 0 to 95 mol %, and more preferably 10 to 75 mol %, with respect to the total constituent units.

It is also preferable for the phosphorylcholine group-containing unsaturated compound to contain as constituent units silane group-containing unsaturated compound units that generate silanol groups when hydrolyzed.

The "silane groups that generate silanol groups when hydrolyzed" here are groups that readily undergo hydrolysis and generate silanol groups upon coming into contact with water. Examples include halogenated silane groups, alkoxysilane groups, phenoxysilane groups, and acetoxysilane groups. Of these, halogenated silane groups and alkoxysilane groups are preferred because of how readily they generate silanol groups.

Examples of the above-mentioned silane group-containing unsaturated compound units include vinyltrimethoxysilane, vinylmethyldimethoxysilane, vinyldimethylmethoxysilane, vinyltriethoxysilane, vinyltrichlorosilane, vinylmethyldichlorosilane, vinyltriacetoxysilane, vinyltriphenoxysilane, vinyltriisopropoxysilane, vinyltris(β-methoxyethoxy)silane, vinylisobutyldimethoxysilane, vinylmethoxydibutoxysilane, vinyltrihexyloxysilane, vinyltrioctyloxysilane, vinylmethyldilauryloxysilane, allyltrichlorosilane, phenylallyldichlorosilane, allyltrimethoxysilane, allylmethyldimethoxysilane, allyltriethoxysilane, allyldimethylethoxysilane, 3-butenyltrimethoxysilane, 5-hexenyldimethylchlorosilane, 7-octenyltrichlorosilane, 19-dodecanyltrimethoxysilane, styrylethyltrimethoxysilane, and other such vinylsilane compounds;

3-(meth)acryloxypropenyltrimethoxysilane, 3-(meth)acryloxypropylbis(trimethylsiloxy)methylsilane, 3-(meth)acryloxypropyidimethylchlorosilane, 3-(meth)acryloxypropyldimethylethoxysilane, 3-(meth)acryloxypropyldimethyidichlorosilane, 3-(meth)acryloxypropylmethyidiethoxysilane, 3-(meth)acryloxypropyltrichlorosilane, 3-(meth)acryloxypropyltribromosilane, 3-(meth)acryloxypropyltrimethoxysilane (3-trimethoxysilylpropyl (meth)acrylate), 3-(meth)acryloxypropyltris(methoxyethoxy)silane, 8-(meth)acryloxyoctanyltrimethoxysilane, 11-(meth)acryloxyundecyltrimethoxysilane, and other such (meth)acryloxyalkylsilane compounds; and 3-(meth)acrylamidopropyltrimethoxysilane, 3-(meth)acrylamidopropyltriethoxysilane, 3-(meth)acrylamidotris(p-methoxyethoxy)silane, 2-(meth)acrylamidoethyltrimethoxysilane, 3-(meth)acrylamidopropyltriacetoxysilane, 4-(meth)acrylamidobutyltriacetoxysilane, 3-(N-methyl-(meth)acrylamido)propyltrimethoxysilane, 2-(N-methyl-(meth)acrylamido)ethyltriacetoxysilane, 2-(meth)acrylamido-2-methylpropylchlorodimethoxysilane, and other such (meth)acrylamidosilane compounds. Of these, 3-methacryloxypropyltrichlorosilane, 3-methacryloxypropyltrimethoxysilane, and 3-methacryloxypropyltriethoxysilane are preferred from the standpoints of superior copolymerizability with MPC, ready availability, and so forth. These phosphorylcholine group-containing unsaturated compounds may be used singly or in combinations of two or more types.

The phosphorylcholine group-containing unsaturated compound preferably contains the above-mentioned silane group-containing unsaturated compound units in an amount of 0.01 to 10 mol % with respect to the total constituent units. Within the above range, bondability with the inner walls of the droplet discharging head will be superior, and biocompatibility attributable to phosphorylcholine groups will tend to be particularly excellent.

This phosphorylcholine group-containing (co)polymer can be manufactured by a method known in the past, or can be obtained as a commercially available product, and can be obtained, for example, from Nippon Yushi (NOF Corporation).

An example of how the phosphorylcholine group-containing (co)polymer coating is applied will now be given.

A phosphorylcholine group-containing (co)polymer is dissolved in an organic solvent (one in which the phosphorylcholine group-containing (co)polymer is soluble) so that the concentration is 0.05 to 10 wt %, and preferably 0.1 to 0.5 wt %, to prepare a coating solution.

Next, a syringe or the like is used to thoroughly fill the internal cavities of the droplet discharging head shown in FIG. 1 with this coating solution through the reservoir chambers 101 or the nozzle holes 106 of the droplet discharging head.

After this, the organic solvent is removed and dried at room temperature or under heating.

The organic solvent may be any solvent in which the phosphorylcholine group-containing (co)polymer is soluble, examples of which include methanol, ethanol, dioxane, and acetone, which can be used alone or as mixed solvents. Of these, methanol and ethanol are preferred in that they have a low boiling point and allow faster drying, and do not affect the bio-related substance if they should remain behind.

If the phosphorylcholine group-containing copolymer includes as constituent units silane group-containing unsaturated compound units that generate silanol groups when hydrolyzed, it is preferable for the organic solvent to contain a small amount of water or an acid because of the necessity to generate silanol.

The coating amount on the inner walls of the droplet discharging head is $10^{-10}$ to $10^{-5}$ mol of the phosphorylcholine group per square centimeter of substrate surface, but $10^{-9}$ to $10^{-5}$ mol is preferable. This range will ensure adequate biocompatibility.

After the drying step discussed above, the droplet discharging head is filled with distilled water and preferably allowed to stand for a while, either at room temperature or under heating. This improves the affinity between water and the coating formed within the droplet discharging head (this treatment is called equilibration).

If the phosphorylcholine group-containing copolymer includes as constituent units the above-mentioned silane group-containing unsaturated compound units, it is preferable for the above-mentioned drying step to be followed by a heat treatment in order to promote crosslinking by dehydration condensation between the silanol groups and hydroxyl groups, amino groups, or the like, or between the silanol groups in the phosphorylcholine group-containing (co)polymer, or to enhance bonding between the silanol groups and the hydroxyl groups, carbonyl groups, amino groups, amide groups, or the like on the surface of the inner walls of the droplet discharging head. This heat treatment is preferable performed for 30 minutes to 24 hours at 60 to 120° C. The heat treatment and drying treatment may be performed simultaneously.

The material that makes up the droplet discharging head is as described above, but from the standpoint of improving bonding with the silanol groups in the phosphorylcholine group-containing copolymer serving as the coating formation component, a material having on its surface hydroxyl groups, carbonyl groups, amino groups, amide groups, or the like that can bond with silanol groups is particularly favorable. If the material has no groups on its surface that can bond with silanol groups, then bonding between the coating and the droplet discharging head serving as the substrate can be enhanced by introducing groups that can bond with silanol groups, such as by introducing hydroxyl groups by an oxidation treatment.

The oxidation treatment of the substrate surface can be accomplished by a conventional method, and may be either chemical or physical treatment. More specifically, in the case of a silicon substrate, for instance, this can be accomplished by the above-mentioned hot oxidation treatment or the like, and other examples include a method involving plasma treatment in a gas containing oxygen, and a method involving treatment with a sulfuric acid solution containing a permanganate.

To drive the droplet discharging head 1 constituted as above, the output voltage from an external power supply 107 is applied between a common electrode 112 composed of a platinum or gold film formed on the right end face of the pressurization chamber substrate 122, and the electrode 108 formed on the electrode substrate 121. This output voltage is a square pulse wave with an amplitude of from 0 to 35 V. As a result, the surface of the electrode 108 is positively charged, while the surface of the opposing pressurization chamber substrate 122 is negatively charged. This causes electrostatic force to act on both components. The bottom of the pressurization chamber 105, which is a thin-walled portion of the pressurization chamber substrate 122, bends slightly and is elastically deformed toward the electrode substrate 121. In other words, the flexible silicon oxide film located at the bottom of the pressurization chamber 105 is subjected to elastic deformation by electrostatic drive, and functions as an oscillating plate 109 that adjusts the pressure inside the pressurization chamber 105. When the voltage being applied to the electrode 108 is then shut off, the electrostatic force is released and the oscillating plate 109 returns to its original position, so there is an instantaneous and sharp increase in pressure inside the pressurization chamber 105, and the sample solution is discharged from the nozzle hole 106 as a microscopic droplet in the form of a dot. The droplet is a microdot of just a few picoliters. The oscillating plate 109 that was bent toward the pressurization chamber 105 bends back toward the electrode substrate 121, which suddenly lowers the pressure inside the pressurization chamber 105, thereby replenishing the sample solution from the reservoir chamber 101 through the channels 102, 103, and 104 to the pressurization chamber 105.

For example, in producing a microarray, a highly integrated probe array (microarray) can be produced by disposing a slide glass or the like as a probe support (solid phase, microarray substrate) in the direction of the droplet discharge, discharging droplets containing various kinds of bio-related substance, such as probe DNA or protein, onto the slide glass, and adsorbing these probes onto the substrate.

With a solution containing probe DNA or any of various proteins, the viscosity will vary tremendously with the type of protein or nucleic acid, so if a different protein solution is discharged from each nozzle using the same droplet discharging head, the amount discharged each time will vary with the nozzle. If the weight of the discharged solution thus varies with the nozzle, the probe accumulation density varies with the spot, so a homogeneous probe array cannot be manufactured. Accordingly, when discharging protein solutions or the like with different viscosities from different nozzles using the same droplet discharging head, the amount of discharge onto the slide glass is adjusted so as to be substantially uniform by presetting the number of droplets discharged from each nozzle.

The weight of droplet spots can be made uniform by adjusting the number of discharges according to the viscosity of the droplets as discussed above, but this can also be accomplished by varying ahead of time the drive voltage settings for each nozzle.

The substances discussed above are used as the probe (bio-related substance) fixed on the solid phase, but more specifically, ligands that bind specifically with receptors, antibodies that bind specifically with antigens, various proteins that bind specifically with enzymes, probe DNA having a base sequence that is complementary to the target DNA, and so forth can also be used as probes.

An electrostatically driven head was used as an example of the droplet discharging head in this embodiment, but the present invention is not limited to this, and a piezoelectric drive type that makes use of piezo elements may also be used.

A microarray manufacturing apparatus equipped with the droplet discharging head of this embodiment will now be described.

Figure 4:
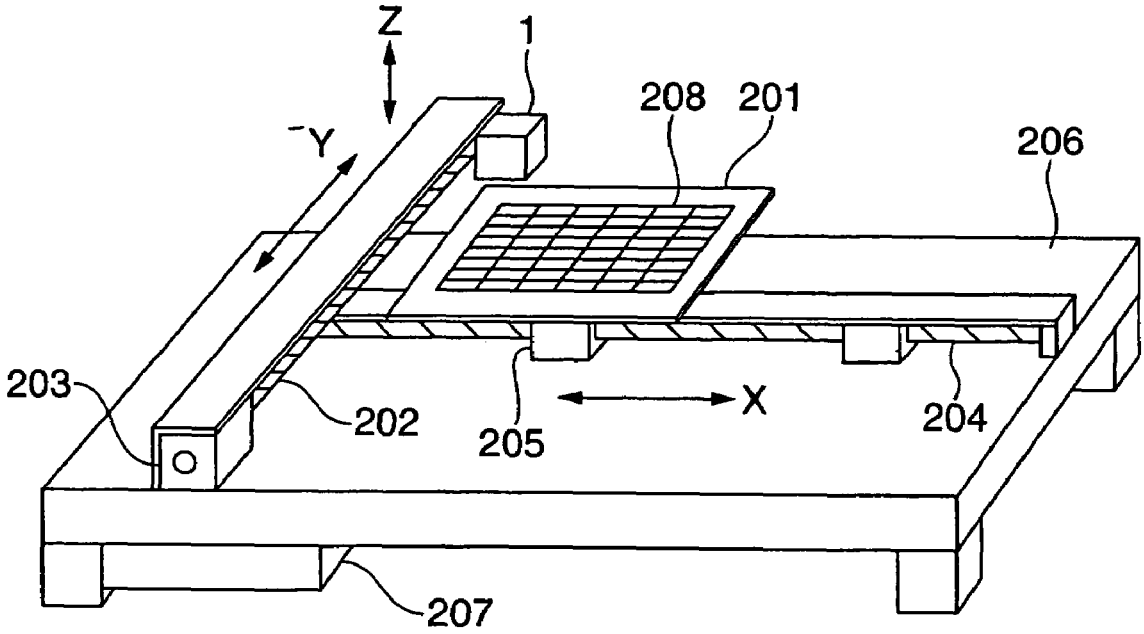
FIG. 4 is a diagram illustrating a specific example of a microarray manufacturing apparatus.

FIG. 4 is a diagram illustrating a specific example of a microarray manufacturing apparatus. The microarray manufacturing apparatus in this drawing comprises the droplet discharging head 1, a work table 201, a Y direction drive shaft 202, an X direction guide shaft 204, a work table drive motor 205, a base 206, and a controller 207. 48 substrates 208 used for the microarray are placed on the work table 201, for example. A microarray can be manufactured by spotting the desired probe solution (bio-related substance-containing solution) onto these substrates 208.

A Y direction drive motor 203 is connected to the Y direction drive shaft 202. The Y direction drive motor 203 is a stepping motor, for example, and when an actuation signal indicating the Y axial direction is supplied from the controller 207, the Y direction drive shaft 202 is rotated. When the Y direction drive shaft 202 is rotated, the droplet discharging head 1 moves in the direction of the Y direction drive shaft 202.

The X direction guide shaft 204 is fixed so as not to move with respect to the base 206. The work table drive motor 205 is connected to the work table 201. The work table drive motor 205 is a stepping motor, for example, and when a drive signal indicating the X axial direction is supplied from the controller 207, the work table 201 is moved in the X axial direction. Specifically, the droplet discharging head 1 can be moved to any place desired on the substrates 208 by driving the work table 201 in the X axial direction and driving the droplet discharging head 1 in the Y axial direction.

The controller 207 supplies the droplet discharging head 1 with drive signals for controlling the timing of the probe solution discharge, the number of discharges, and so forth. The controller 207 also supplies the Y direction drive motor 203 and the work table drive motor 205 with drive signals for controlling the operation of these motors.

The above-mentioned Y direction drive shaft 202, Y direction drive motor 203, and controller 207 correspond to scanning drive means, while the X direction drive shaft 202, work table drive motor 205, and controller 207 correspond to position control means.

With the probe array manufacturing apparatus of the present invention constituted as above, more types of probe solution can be discharged onto the substrates 208, which makes the work far more efficient.

As described above, with this embodiment the portion [of the head] that comes into contact with the sample solution, and particularly a solution containing a bio-related substance, is coated with a (co)polymer containing phospholipid polar groups (phosphorylcholine groups), which are constituent components of biological membranes, so a droplet discharging head with excellent biocompatibility can be provided. Therefore, it is possible to prevent discharge problems caused when components in the sample solution adsorb to the inner walls of the droplet discharging head, for example, and the problem of deactivation due to a change in structure when a bio-related substance (such as a protein) adsorbs to the inner walls of the droplet discharging head can be prevented. Also, since adsorption of the sample to the walls and so forth can be prevented, it should be possible to prevent changes in the concentration of the sample solution over time as well.

Because the main constituent members of the droplet discharging head are a glass substrate and a silicon substrate, this head can be easily designed and worked by means of a lithographic process utilized in the manufacture of semiconductors and so forth, and furthermore changes to device parameters can be made merely by changing the pattern of the photomask, which makes design modifications much simpler. In particular, if we compare the viscosity of a solution containing protein or the like to that of ordinary ink, we see that properties such as viscosity and surface tension vary dramatically with the type of protein or the like, so the nozzle diameter, nozzle pitch, and other such dimensions of the droplet discharging head must be optimized, but this is no problem since design changes can be easily made merely by changing the pattern of the photomask. Furthermore, since high-precision fine working is possible in a semiconductor manufacturing process, dimensional precision is good, and there is no variance in the size of the droplet spots in the manufacture of a microarray (probe array). Also, since a semiconductor manufacturing process can be utilized, the cost is low and productivity is excellent.

Also, since anodic joining can be utilized as the means for joining the borosilicate glass substrate and the silicon substrate, joining can be accomplished very simply. Moreover, because the head is driven electrostatically, there is no danger of proteins and so forth being modified, as is the case with a Bubble Jet® system, and since the apparatus structure is extremely simple, the droplet discharging head can be more compact, with less dead volume. It is also possible to form spots at higher density by reducing the pitch between nozzles. In addition, electrostatic drive affords high actuator reliability and long service life, and since high-frequency drive is possible, high-speed discharge is also possible.

Furthermore, with the microarray manufacturing apparatus of this embodiment, more types of probe solution (solution containing a bio-related substance) can be discharged onto the substrates, which makes the work far more efficient.

EXAMPLES

Example 1

Readying a Droplet Discharging Head

The droplet discharging head shown in FIG. 1 was readied.

Silicon was used for the pressurization chamber substrate and nozzle substrate, borosilicate glass was used for the electrode substrate, and PMMA (a methacrylic resin) was used for the reservoir component.

Preparation of coating solution:

A copolymer of MPC and MPTMS (3-methacryloylpropyltri-methoxysilane) with a molar ratio of 9:1 was readied (hereinafter referred to as MPC-MPTMS copolymer). This MPC-MPTMS copolymer was dissolved in ethanol to prepare a 0.1% ethanol solution.

The MPC-MPTMS copolymer was manufactured by the following method. The MPC was made by NOF Corporation, while the MPTMS was made by Shin-Etsu Silicone.

Specific amounts of MPC and MPTMS were each dissolved in 5 mL of ethanol, after which these solutions were mixed so that the monomer ratio would be 90/10, and this mixture was diluted with ethanol so that the total monomer concentration would be 10 wt %, thereby preparing a 15 mL monomer solution. This monomer solution was put in a glass reaction vessel along with 0.01 mmol of AIBN (a polymerization initiator), nitrogen replacement was performed for 5 minutes, and the vessel was sealed. A polymerization reaction was conducted for 6 hours in an oil bath set at 60° C. The system was cooled to normal temperature, after which the vessel was opened and reprecipitation was performed using 300 mL of a mixed solution (volumetric ratio of 7:3) of ether and chloroform (weak solvent) contained in a 500 mL beaker. After this, the system was dried overnight under reduced pressure, the product of which was once more dissolved in 15 mL of ethanol and subjected to reprecipitation under the same conditions, then dried overnight under reduced pressure to obtain the targeted MPC-MPTMS copolymer. The MPC composition in the MPC-MPTMS copolymer was confirmed by NMR measurement in heavy ethanol.

Formation of Coating:

A syringe was used to inject a 0.1 wt % ethanol solution of the above-mentioned MPC-MPTMS copolymer as a coating solution from the reservoir chamber of the droplet discharging head readied above so as to fill the channels of the droplet discharging head. This state was maintained for 1 minute, after which the coating solution was removed by suction. This state was maintained for 1 hour at 80° C. to dry off the coating solution and fix the coating. The coating was then subjected to an equilibration treatment by soaking the above for at least 2 hours in pure water. This yielded a droplet discharging head coated with an MPC-MPTMS copolymer.

Comparative Example 1

The same droplet discharging head as in Example 1 was given no coating, and this product was termed Comparative Example 1.

Evaluation Test

The discharge performance of the droplet discharging head was evaluated from how well it discharged an insulin solution. The discharge of the insulin solution was evaluated by the ELISA method. An Insulin, Mouse, ELISA Kit (96-well) made by Mercodia was used as the test kit in this ELISA method.

The specific procedure is described below.

First, five types of insulin solution were prepared with different concentrations of 0.28 μg/L, 0.67 μg/L, 1.6 μg/L, 3.9 μg/L, and 6.8 μg/L.

These five types of insulin solution were each put in a droplet discharging head, and 13,000 shots were discharged into each of the wells of the plate. If all 13,000 shots could be discharged properly, the total amount was 25 μL. The discharge conditions comprised f=2 kHz, Pw=20 μsec, and 38 V.

Next, 50 μL of HRP-labeled insulin antibody was put in each of the wells containing the insulin solution, after which the solutions were incubated for 2 hours at room temperature while being shaken with a shaker.

The supernatant was suctioned off with a Pasteur pipette, and then washing was performed five times with a 350 μL washing solution. The washing solution was removed, after which a TMB substrate (HRP substrate) was supplied in an amount of 200 μL to each well and allowed to stand for 15 minutes. 50 μL of sulfuric acid was then added as a reaction stopper and shaken for 5 seconds with a shaker, after which a plate reader was used to measure the absorbency at 450 nm.

The droplet discharging head of Comparative Example 1 (with no coating) was evaluated for discharge performance by the same method as above. As a reference example, the above-mentioned five types of insulin solution of different concentrations were supplied to the various wells using a micropipette, and the same evaluation as above was conducted.

Figure 5:
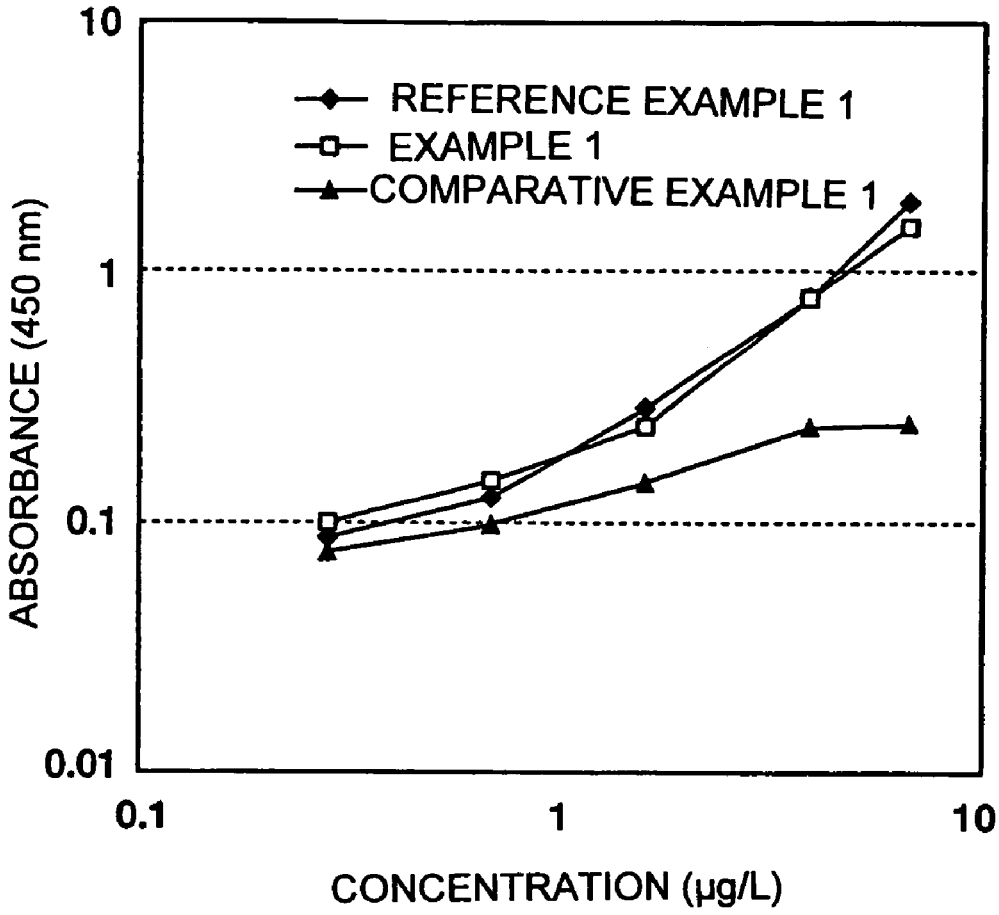
FIG. 5 is a graph of the results of evaluating the discharge performance of the droplet discharging head.

FIG. 5 shows the results of evaluating the discharge performance of the droplet discharging heads.

As shown in FIG. 5, when the coated droplet discharging head of Example 1 was used, the absorbency was substantially the same as that when 25 μL of each [solution] was supplied with a micropipefte as in the reference example. Therefore, with the coated droplet discharging head of Example 1, there was no adsorption, modification, etc., of the insulin inside the droplet discharging head, and good discharge was possible. On the other hand, when the uncoated droplet discharging head of Comparative Example 1 was used, there was a drop in absorbency at every insulin concentration. One possible reason for this drop in absorbency is that when the droplet discharging head of Comparative Example 1 was used, there were times when no droplets were discharged, so that the entire amount of insulin solution was not discharged.

The entire disclosures of Japanese patent applications Nos. 2004-109851 filed Apr. 2, 2004 and 2003-150277 filed May 28, 2003 are hereby expressly incorporated by reference.

What is claimed is:

1. A droplet discharging head for discharging a sample solution comprising:

a reservoir component;

a pressurization chamber including nozzle holes;

and channels leading from the reservoir component to the pressurization chamber, wherein the portion of the inner walls of the droplet discharging head that comes into contact with the sample solution is covered with a polymer composed of phosphorylcholine group-containing unsaturated compound units, or a copolymer including same.

2. The droplet discharging head according to claim 1, wherein the head is an electrostatic drive or piezoelectric drive type.

3. A droplet discharging head for discharging a sample solution, comprising:

a first substrate having one or more electrodes on the surface thereof;

a second substrate that has an oscillating plate disposed so as to oppose the portion of the first substrate where the electrode is installed, with a microscopic gap therebetween, and elastically deforming under electrostatic force corresponding to the potential difference from the electrode, and that has one or more pressurization chambers whose internal pressure is regulated by the displacement of the oscillating plate, and which pushes the sample solution filled in said pressurization chamber out through nozzle holes;

a third substrate having one or more nozzle holes for discharging the sample solution pushed out of the pressurization chamber; and a reservoir component that is disposed on the other side of the first substrate and has a reservoir chamber for holding the sample solution, wherein channels leading from the reservoir component to the pressurization chamber are provided to the first substrate and second substrate, and the inner walls of at least the reservoir component, the pressurization chamber, the channels, and the nozzle holes are covered with a polymer composed of phosphorylcholine group-containing unsaturated compound units, or a copolymer including same.

4. The droplet discharging head according to claim 1 or 3, wherein the phosphorylcholine group-containing unsaturated compound units are 2-methacryloyloxyethyl phosphorylcholine units.

5. The droplet discharging head according to claim 1 or 3, wherein the copolymer including phosphorylcholine group-containing unsaturated compound units includes as constituent units 2-methacryloyloxyethyl phosphorylcholine units and (meth)acrylic ester units.

6. The droplet discharging head according to claim 1 or 3, wherein the copolymer including phosphorylcholine group-containing unsaturated compound units includes as constituent units 2-methacryloyloxyethyl phosphorylcholine units and silane group-containing unsaturated compound units that generate silanol groups when hydrolyzed.

7. The droplet discharging head according to claim 1 or 3, wherein the droplet discharging head is composed of glass and/or silicon.

8. The droplet discharging head according to claim 3, wherein the first substrate is a glass substrate, and the second substrate is a silicon substrate.

9. The droplet discharging head according to claim 8, wherein the second substrate is a silicon substrate, and a silicon oxide film is further formed between the inner walls of the pressurization chamber with which the second substrate is equipped and the coating formed by the polymer composed of phosphorylcholine group-containing unsaturated compound units, or a copolymer including same.

10. The droplet discharging head according to claim 3, wherein the nozzle surface near the nozzle holes is water-repellant.

* * * * *